US008647692B2

(12) United States Patent
Giazzon et al.

(10) Patent No.: US 8,647,692 B2
(45) Date of Patent: Feb. 11, 2014

(54) COMBINED PROCESS FOR GENERATING STEAM IN A STEAM-BAKING OVEN, AND OVEN FOR CARRYING OUT THE PROCESS

(75) Inventors: Paolo Giazzon, Belluno (IT); Massimo Tesser, Belluno (IT); Paolo Candiago, Belluno (IT)

(73) Assignee: Giorik S.p.A., S. Gregorio nelle Alpi (BL) (IT)

( * ) Notice: Subject to any disclaimer, the term of this patent is extended or adjusted under 35 U.S.C. 154(b) by 114 days.

(21) Appl. No.: 12/902,327

(22) Filed: Oct. 12, 2010

(65) Prior Publication Data

US 2011/0086143 A1 Apr. 14, 2011

(30) Foreign Application Priority Data

Oct. 13, 2009 (IT) ..... PN2009A0057

(51) Int. Cl.
*A23P 1/00* (2006.01)

(52) U.S. Cl.
USPC ..... 426/510; 426/511; 426/233; 426/520; 99/474; 99/476; 126/369; 126/20

(58) Field of Classification Search
USPC ..... 426/510, 231, 233, 511, 520; 99/474, 99/476; 126/20, 369
See application file for complete search history.

(56) References Cited

U.S. PATENT DOCUMENTS

| | | | | |
|---|---|---|---|---|
| 3,891,773 | A * | 6/1975 | Kline et al. | 426/61 |
| 4,058,653 | A | 11/1977 | Boucheron et al. | |
| 4,531,306 | A * | 7/1985 | Erickson | 34/546 |
| 5,694,834 | A * | 12/1997 | Le Dall et al. | 99/353 |
| 5,768,982 | A | 6/1998 | Violi et al. | |
| 6,267,045 | B1 * | 7/2001 | Wiedemann et al. | 99/330 |
| 6,516,712 | B1 * | 2/2003 | Ratermann et al. | 99/476 |
| 6,854,457 | B2 * | 2/2005 | Rabas et al. | 126/21 A |
| 2006/0096970 | A1 * | 5/2006 | Yang et al. | 219/401 |

FOREIGN PATENT DOCUMENTS

| | | |
|---|---|---|
| DE | 3821205 | 12/1989 |
| DE | 10256889 | 6/2004 |
| DE | 102008008020 | 8/2009 |

* cited by examiner

*Primary Examiner* — Drew Becker
*Assistant Examiner* — Preston Smith
(74) *Attorney, Agent, or Firm* — Shoemaker and Mattare

(57) ABSTRACT

The present invention refers to a combined process for generating steam in a steam-baking oven. The oven (2) comprises a baking chamber (3) containing at least one air heating element (10) and at least one fan (4) to keep the air moving inside the baking chamber (3); the oven (2) is associated with a steam generator (5) and is connected to a water supply (6). The combined process includes a saturation step, in which the steam generator (5) is activated until a substantial steam saturation is obtained in the baking chamber (3), and a spraying step in which the steam generator (5) is deactivated and the steam is produced by spraying water onto the heating elements (10); the steam generator (5) is temporarily and periodically activated during the spraying step to keep the steam quality substantially constant.

5 Claims, 3 Drawing Sheets

COMBINED PROCESS FOR GENERATING STEAM IN A STEAM-BAKING OVEN, AND OVEN FOR CARRYING OUT THE PROCESS

FIELD OF INVENTION

The present invention refers to a combined process for generating steam in a steam-baking oven, and to a steam oven, particularly of commercial type, for thawing and/or cooking food, that carries out said process.

BACKGROUND OF INVENTION

As is well known, steam baking is increasingly appreciated for the quality of the results; for example, it makes it possible to keep many types of food, such as meat, tender, even when they are cooked at high temperatures and in ventilated ovens, that is with forced air circulation.

Steam is generated in these ovens in various ways.

In a first case, the oven is equipped with a specially provided boiler, which is arranged outside the baking chamber. When the water is brought to a boil in the boiler, the steam is conveyed to the baking chamber of the oven. Steam production is constant, but this solution has the drawback of being more complex and cumbersome due to the overall dimensions of the equipment and the necessity of having specially provided connections.

In a second case, steam is generated directly in the baking chamber by spraying water on the heating elements. In this case, the heating elements cool down when the water hits them, and the quality of the steam is affected. To eliminate this problem, the injection of water is timed in such a way as to allow the heating elements to resume their steady state temperature. Thus the generation of steam is not constant.

U.S. Pat. No. 4,058,635 discloses a cooking process in a ventilated oven. Water or steam are added to the air that is circulated in the baking chamber in such a quantity and times that can be adjusted on the basis of the required cooking characteristics. In particular, the steam is generated in a boiler that is separated from the oven and connected to it through a duct in which a timed valve is inserted to feed water or steam in pulses lasting from 0.3 to 1.2 seconds at intervals of 0.25 to 2 minutes.

The main objective of the present invention is to carry out a process in which the two methods of steam generation mentioned above are combined. For this purpose, a steam generator is used, in particular a low-power one of electric type, suitable to generate a certain quantity of steam in a short time at the start of the cooking cycle, and in which the quality of the steam remains constant during the phase of direct injection achieved by spraying water onto the oven heating elements.

The oven according to the present invention makes it possible to achieve faster cooking times and with excellent results.

The innovative characteristics of the oven according to the invention are defined in the attached claim 1.

The objectives and advantages of the oven according to the invention will become evident from the description hereunder, given by way of non-limiting example, with reference to the enclosed drawings, wherein:

FIG. 1 schematically illustrates, in a front elevation, a baking oven provided with a steam generation device according to the present invention;

FIG. 2 schematically illustrates the steam generation device of FIG. 1 in a side view lateral to the mouth of the oven;

Figure 1:
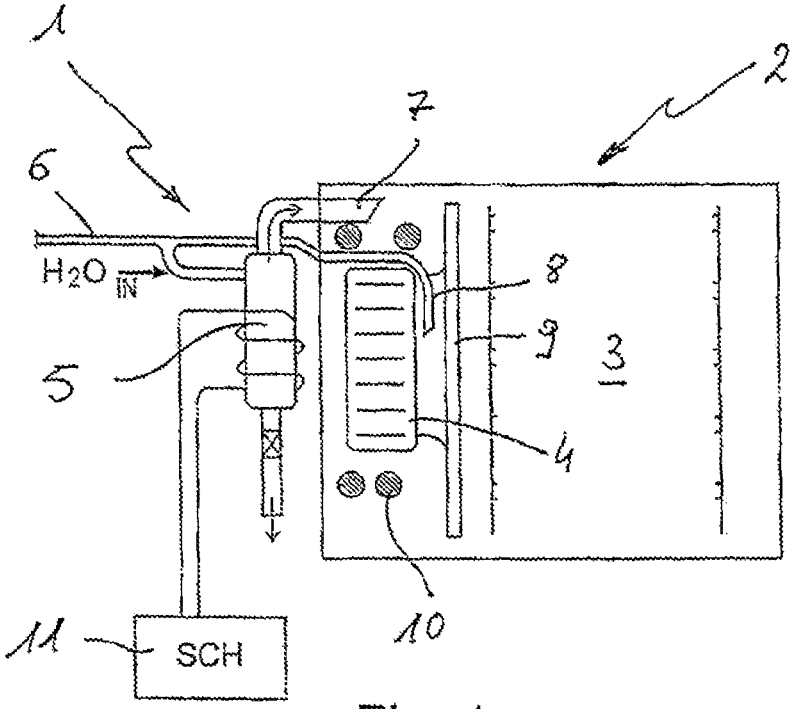
Figure 2:
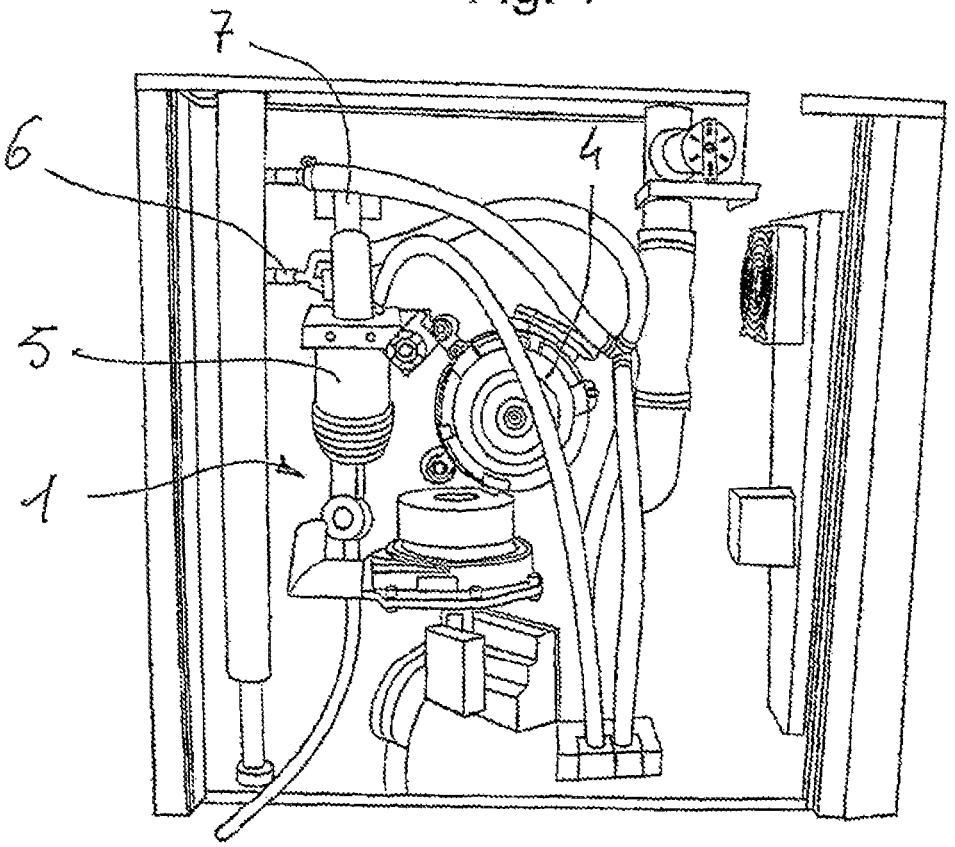
Figure 4:
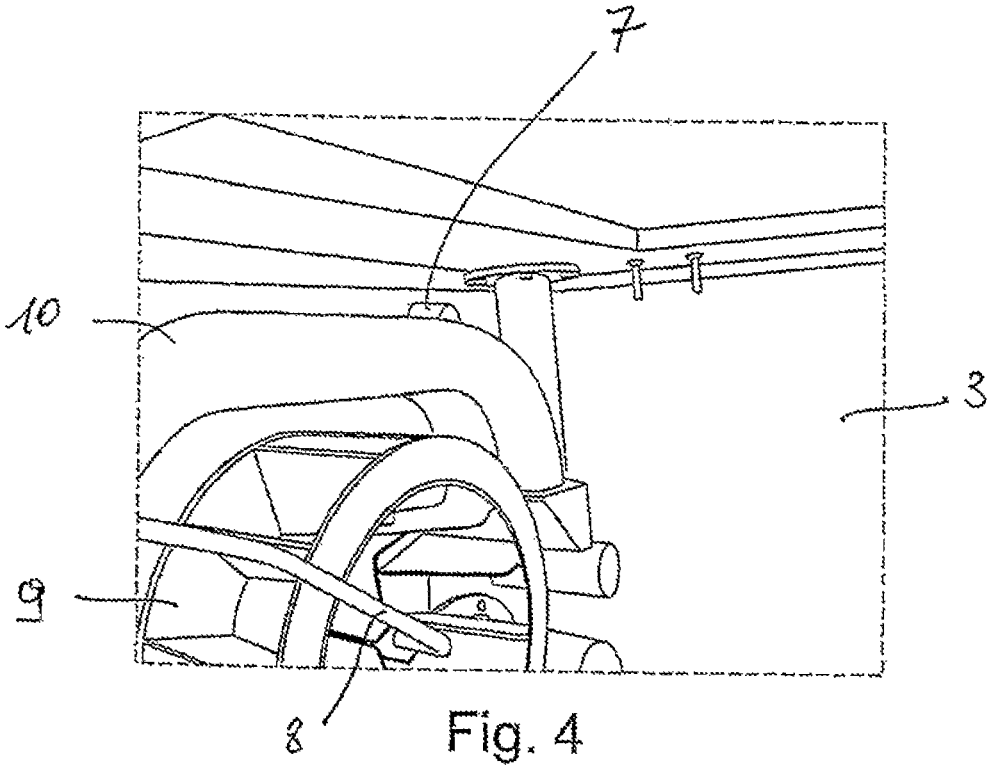
FIG. 4 is a detail of FIG. 3.
Figure 3:
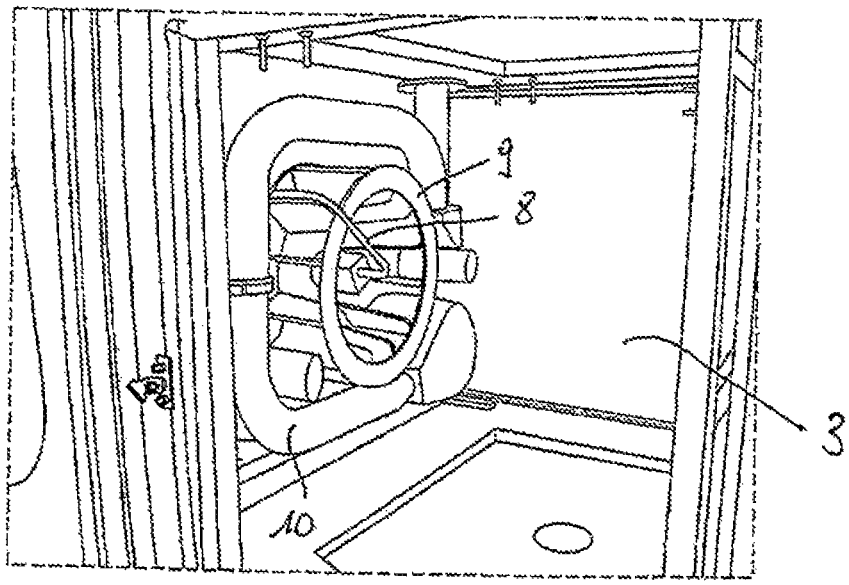
FIG. 3 shows the inside of the chamber in the oven of the previous figures.

With reference to the above-mentioned figures, reference numeral 1 is used to indicate a steam generating device associated with a food baking oven 2.

The oven 2 comprises a baking chamber 3 containing at least one air heating element, consisting for example of a heat exchanger 10 or of one or more electrical heating elements of known type on one or more walls of the baking chamber 3, and at least one fan 4 to keep the air in motion inside the baking chamber 3 and arranged adjacent to the heating element.

The steam generating device 1 associated with the oven 2 comprises a steam generator 5 connected to a water supply 6 and provided with a steam outflow duct 7 communicating with the baking chamber 3.

A water injection pipe 8, which is also connected to the water supply 6, is arranged inside the baking chamber 3 to spray water against the wall of the chamber 3 provided with the heating elements, preferably where the fan 4 is located.

Inside the baking chamber 3 there is also a deflector 9 arranged in front of and coaxially to the fan 4 to distribute and convey in a substantially uniform manner the hot air and/or the steam in the chamber 3.

Similarly, if the heating element consists of the heat exchanger 10, the latter surrounds the deflector 9 at least partially so that the heat is distributed more or less uniformly in the chamber 3.

Suitable control means 11, such as a printed circuit board, control the activation and deactivation of the steam generator 5 to carry out the process as will be better explained hereinbelow.

Figure 5:
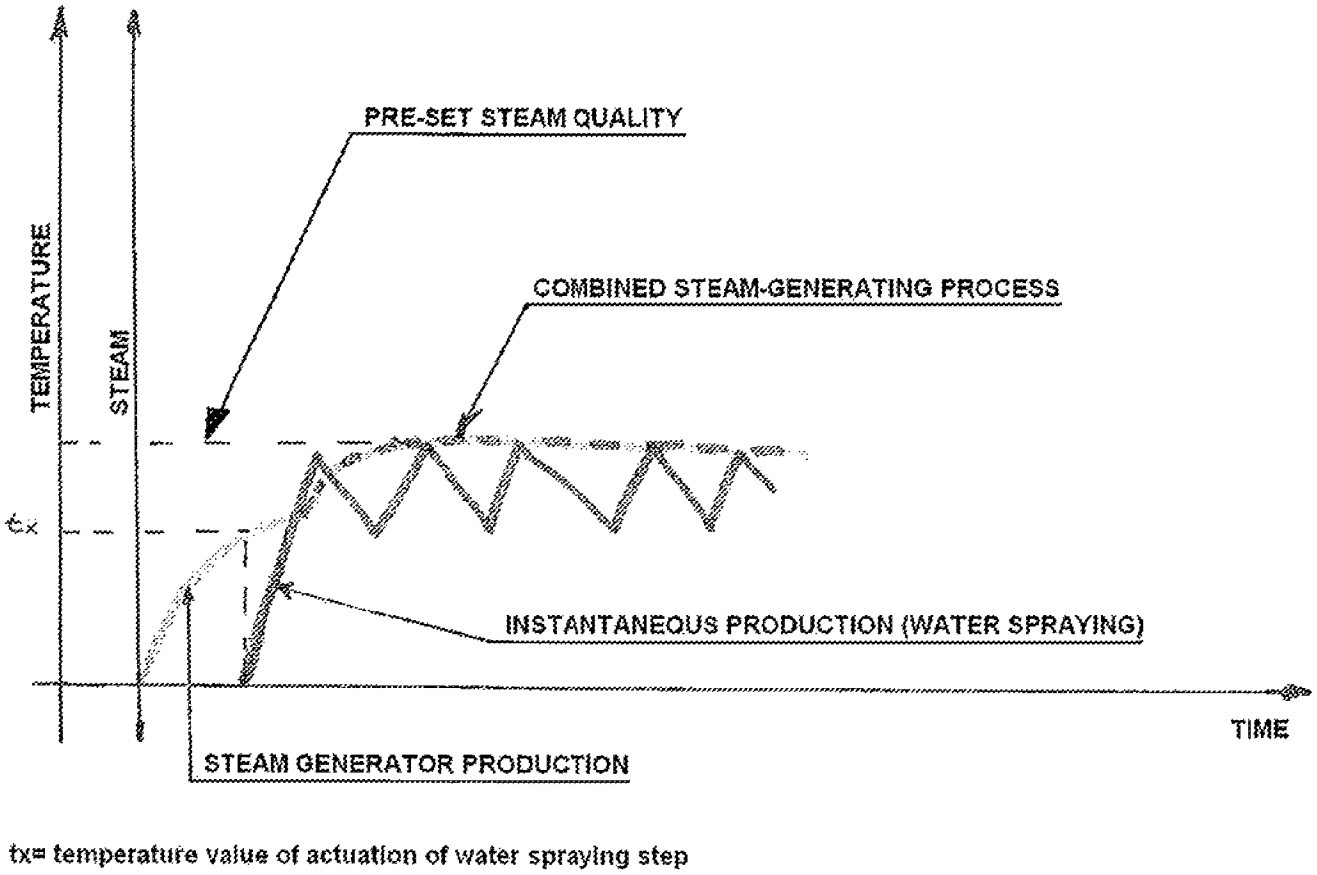
FIG. 5 is a diagram showing the steam generation as a function of time in an oven that implements a process according to the present invention.

The combined steam generating process in the baking oven 2 includes a saturation step, in which the steam generator 5 is activated to obtain a substantial steam saturation in the baking chamber 3 through the steam supplied by the steam feeding pipe 7, and a spraying step in which the steam generator 5 is switched off and the steam in the baking chamber 3 is produced by water sprayed onto the heating elements through the water injection pipe 8. During the spraying step, the steam generator is temporarily and periodically activated to maintain the quality of the steam substantially constant, as exemplified in the diagram of FIG. 5, which shows how the combined process according to the present invention stabilizes the steam at the moment in which the instantaneous production drops by effect of the cooling down of the heating elements during the spraying step.

The activation and deactivation of the steam generator 5 is controlled by the control means 11, which are controlled by suitable sensing means detecting the percentage of moisture inside the chamber 3.

Advantageously, the steam generator 5 is thermostatically maintained in a pre-heating condition to enable it to be quickly activated at least during the spraying step.

With the process as described above, the temporary and periodic activation of the steam generator 5 during the spraying step, when the baking chamber 3 is saturated with steam, comprises a further feeding of steam into the chamber 3 that makes it possible to carry out cooking in static conditions, that is without stirring the air.

In addition, the saturation step may come before or after the spraying step, without thereby altering the substance of the inventive concept underlying the process described above.

From the above, it is thus evident how the present invention achieves the objectives and advantages initially set down: in fact a process was thought out in which two manners of steam generation, that is, by means of the steam generator 5 and by means of spraying water on the heating elements through the injection pipe 8, are combined with each other to supply a substantially constant steam quality, except for the initial starting phase, during the whole food cooking process. In fact, the temporary activation, controlled by the control means 11, of the steam generator 5 during the spraying phase makes it possible to restore the quality, or the correct percentage of humidity, of the steam at the moment in which the instantaneous production drops due to effect of cooling the heating elements during the spraying step.

With the process according to the present invention it is thus possible to achieve faster food cooking cycles while still maintaining an excellent level of cooking quality.

Naturally, the present invention is susceptible of numerous applications, modifications or variants without thereby departing from the scope of protection as defined by claim 1.

Moreover, the materials and equipment used to implement the present invention, as well as the shapes and dimensions of the individual components, may be the most suitable according to the specific requirements.

We claim:

1. A method for generating steam in steam-baking oven (2) for steam-baking food, said steam-baking oven (2) comprising a baking chamber (3) including at least one heating member (10) and at least one fan (4) to circulate air inside the baking chamber (3), said steambaking oven (2) being associated to a steam generator (5) and being connected to a water supply (6), a water injection pipe (8) being connected to said water supply and being arranged inside said baking chamber (3) to spray water against said heating member (10), said method comprising steps of:

a first step, wherein said steam generator (5) is activated until said baking chamber (3) is substantially steam-saturated, and a second step wherein said steam generator (5) is switched-off and steam is generated by spraying water on said at least one heating member (10) through said water injection pipe, and then temporarily and periodically activating said steam generator during said second step when steam production produced by spraying water drops as a result of cooling down of said heating member, to keep steam quality substantially unchanged.

2. Method as recited in claim 1, wherein activation and deactivation of said steam generator (5) is controlled by control means (11) operated by sensing means adapted to detect the humidity percentage in said baking chamber (3).

3. Method as recited in claim 1, wherein said steam generator (5) is kept in a pre-heated state by thermostatic control so as to be quickly activated at least during said second step.

4. Method as recited in claim 1, wherein the temporary and periodic activation of said steam generator (5) during said second step, when said baking chamber (3) is saturated of steam, causes further steam to enter into said baking chamber (3) such that baking in a static condition is allowed.

5. Oven for steam-baking food comprising a steam generator (5), a baking chamber (3), control means (11) adapted to activate and deactivate said steam generator, said control means being operated by sensing means adapted to detect the humidity percentage in said baking chamber (3), a water injection pipe (8) arranged inside said baking chamber (3) to spray water against said heating member (10), wherein the steam is formed by activating said steam generator until said baking chamber is substantially steam-saturated, switching off said steam generator and generating steam by spraying water on said at least one heating member through said water injection pipe, temporarily and periodically activating said steam generator during said second step when steam production produced by spraying water drops as a result of cooling down of said heating member, to keep steam quality substantially unchanged.

* * * * *